US008528269B2

(12) United States Patent
Chich et al.

(10) Patent No.: US 8,528,269 B2
(45) Date of Patent: Sep. 10, 2013

(54) FASCIA VENT

(75) Inventors: Adem Chich, Kearney, NJ (US); Edward C. Villela, Leonia, NJ (US); Sudhir Railkar, Wayne, NJ (US)

(73) Assignee: Building Materials Investment Corporation, Dallas, TX (US)

( * ) Notice: Subject to any disclaimer, the term of this patent is extended or adjusted under 35 U.S.C. 154(b) by 757 days.

(21) Appl. No.: 12/194,068

(22) Filed: Aug. 19, 2008

(65) Prior Publication Data

US 2010/0043311 A1 Feb. 25, 2010

(51) Int. Cl.
*E04B 7/00* (2006.01)
*E04D 3/40* (2006.01)
*E04D 13/00* (2006.01)

(52) U.S. Cl.
USPC ..... 52/95; 52/302.3; 52/741.1

(58) Field of Classification Search
USPC ..... 52/95, 302.1, 302.3, 741.1, 199, 52/503, 606, 607, 92.1, 203, 473, 303, 305, 52/361; 454/364, 365, 366
See application file for complete search history.

(56) References Cited

U.S. PATENT DOCUMENTS

| | | | | | |
|---|---|---|---|---|---|
| 248,858 | A | * | 11/1881 | Hayes | 52/95 |
| 2,676,554 | A | | 4/1954 | Wenger | |
| 2,954,727 | A | * | 10/1960 | Katt et al. | 454/260 |
| 3,373,676 | A | | 3/1968 | Dunnington et al. | |
| 3,683,785 | A | | 8/1972 | Grange | |
| 4,607,566 | A | * | 8/1986 | Bottomore et al. | 454/260 |
| 4,665,675 | A | * | 5/1987 | Kelly | 52/534 |
| 4,807,409 | A | * | 2/1989 | Sells | 52/95 |
| 4,995,308 | A | | 2/1991 | Waggoner | |
| 5,540,015 | A | * | 7/1996 | Anthony | 52/95 |
| 5,560,157 | A | * | 10/1996 | Rotter | 52/95 |
| 5,761,864 | A | * | 6/1998 | Nonoshita | 52/302.3 |
| 5,996,289 | A | | 12/1999 | Allaster | |
| 6,932,901 | B2 | | 8/2005 | Crosby | |
| 2005/0246973 | A1 | * | 11/2005 | Jensen | 52/95 |
| 2006/0099405 | A1 | * | 5/2006 | Guiselin et al. | 428/323 |
| 2007/0049190 | A1 | * | 3/2007 | Singh | 454/365 |
| 2007/0074483 | A1 | * | 4/2007 | Beck | 52/741.13 |

FOREIGN PATENT DOCUMENTS

| | | | |
|---|---|---|---|
| EP | 0 787 238 | B1 | 1/2000 |
| JP | 10030830 | A | 2/1998 |
| JP | 2001003511 | A | 1/2001 |
| JP | 2003155809 | A | 5/2003 |
| JP | 2006063755 | A | 3/2006 |
| JP | 2007204970 | A | 8/2007 |

* cited by examiner

*Primary Examiner* — Joshua J Michener
*Assistant Examiner* — Theodore Adamos
(74) *Attorney, Agent, or Firm* — Womble Carlyle Sandridge & Rice, LLP

(57) ABSTRACT

A fascia vent for a roof structure includes a fascia board for attachment along the lower ends of roof rafters that support a roof deck above an attic space. The fascia vent has an exposed outside face and an inside face at least partly exposed to the attic space. A plurality of slots are formed along the inside face of the fascia board with a lower end of the slots communicating with ambience along the bottom edge of the fascia board and an upper end of the slots communicating with the attic space. In use, hot air vented from the attic is replaced by fresh air that flows through the lower ends of the slots and into the attic space.

25 Claims, 3 Drawing Sheets

FASCIA VENT

TECHNICAL FIELD

This disclosure relates generally to attic ventilation and more specifically to fascia vents.

BACKGROUND

Modern attic ventilation systems usually include outlet vents high on a roof through which hot air escapes from the attic, coupled with inlet vents in the soffit or eve regions of the roof. The outlet vents might, for instance, comprise ridge vents that extend along and cover a slotted roof ridge while inlet vents might include a plurality of louvered vents covering openings cut in the soffit. As hot air escapes the attic through the outlet vents by means of convection, which may be aided by vent fans in some cases, it is replaced by cooler outside air that is drawn into the attic through the inlet vents.

Many styles and configurations of inlet vents for attic spaces have been designed and used in the past. These include independent louvered soffit vents, continuous strips of louvered soffit vent, ventilating material installed behind or atop fascia boards, and complicated louvered fascia vents. A need persists, however, for an inlet vent that is effective, easily installed by the common carpenter, and virtually undetectable when installed. It is to the provision of such an inlet vent that the present invention is primarily directed.

SUMMARY

Briefly described, a combination fascia board and vent, referred to as a fascia vent, comprises an elongated fascia board having a width appropriate to form the fascia of a gable roof overhang. In one embodiment, the fascia board is fabricated of extruded plastic composite material, which may be formed with a hollow interior having longitudinally extending ribs forming longitudinal channels on the interior of the strip. Other materials, such as, for instance, solid plastics, solid composites, blown and skinned plastics, and wood may be used. In any event, the fascia board is formed on its inside face with a plurality of spaced slots arrayed along a bottom edge and each slot extends laterally only part way across the width of the fascia board. The fascia board is installed by being fastened to the lower ends of the roof rafters with the array of spaced slots facing inwardly and with their bottom ends exposed to ambience along the bottom edge of the fascia board. Soffit boards are installed beneath the overhang between the fascia boards and the outside wall of a dwelling in the traditional way.

The exposed bottom ends of the slots in conjunction with the lengths of the slots provide vent paths for outside air to enter the attic. The number and spacing of the slots is selected to provide appropriate ventilating capacity to support the effective replenishment of the attic with fresh outside air as hot air exits the attic through the outlet vents. Thus, circulation is established that helps reduce the temperature within the attic as was as helping to prevent formation of mold and mildew due to trapped stagnant moist air. The fascia vent of this disclosure is thus an effective inlet vent for a variety of roof constructions including any roof with a ridge or gable or power exhaust vents. Further, it requires no special talent or tools to install since it is applied by a carpenter in the same manner as traditional fascia boards. Since the installation of the fascia board and vent are accomplished in a single operation, significant time is saved as compared to installing soffit or eve vents separately and in addition to the installation of fascia boards.

In another application, the fascia vent offers the additional benefit of providing for the venting of intake air into a structure that does not have conventional soffits or overhangs. In such installations, the fascia vent is installed against the outside wall of the structure beneath the roof decking. The slots in the back side of the fascia vent provide air passages for the flow in inlet air into the attic above.

These and other objects, features, and advantages of the fascia vent disclosed herein will become more apparent upon review of the detailed description set forth below when taken in conjunction with the accompanying drawing figures, which are briefly described as follows.

DETAILED DESCRIPTION

Figure 1:
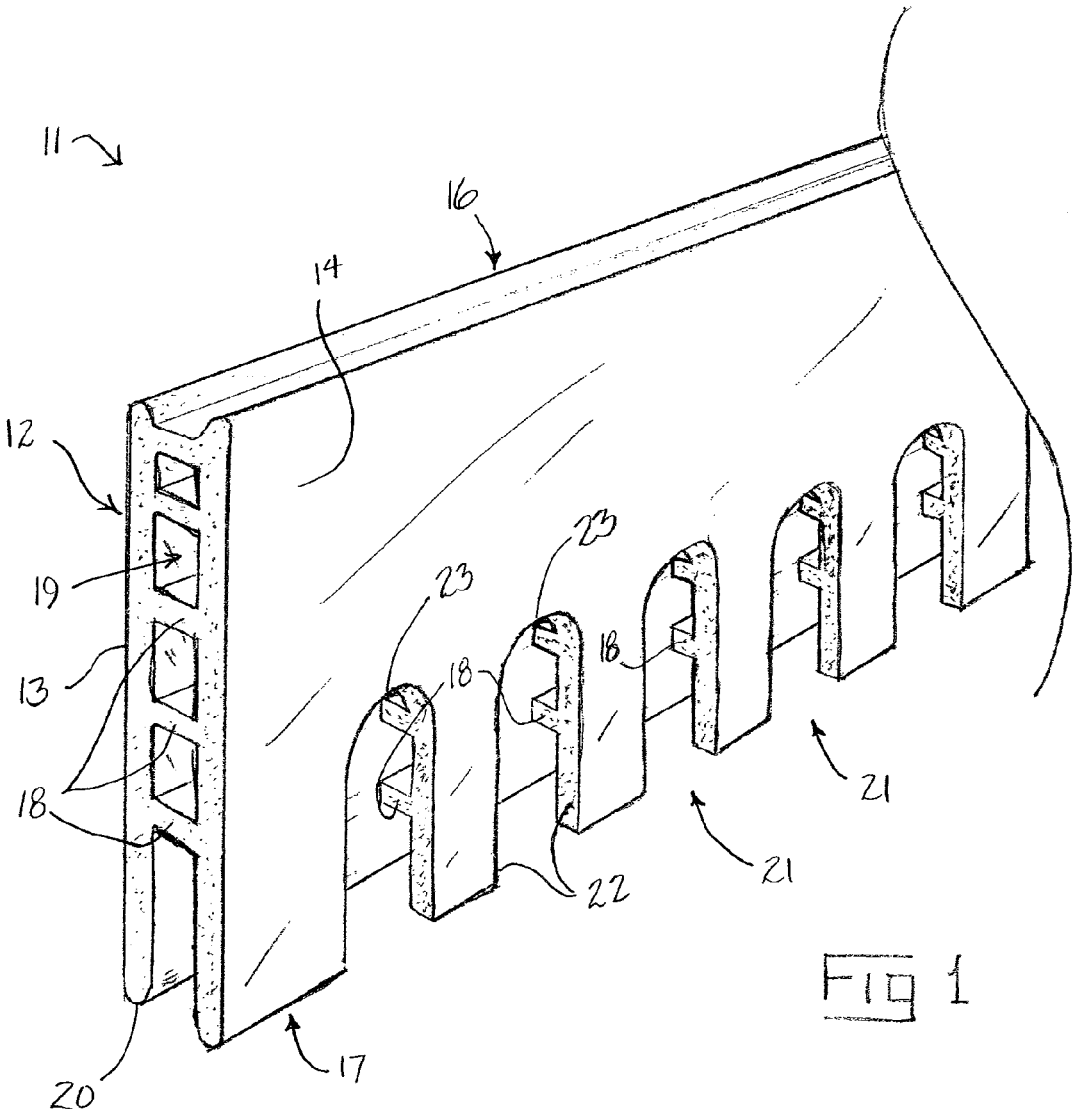
FIG. 1 is a perspective view of the inside face of a fascia vent that embodies principles of the present invention in one possible configuration.

Reference is now made in more detail to the drawing figures, wherein like reference numerals refer, where appropriate, to like parts in the several views. FIG. 1 illustrates a fascia vent that embodies principles of the invention in one possible configuration. The fascia vent 11 comprises an elongated fascia board 12 having an outside face 13 and an inside face 14. The outside face 13 and inside face 14 are spaced apart from each other and are connected together by a plurality of longitudinally extending internal ribs 18. The internal ribs 18, in turn, define a plurality of longitudinally extending interior channels 19 along the length of the fascia board 12. The fascia board 12 also has a top edge 16 and a bottom edge 17. At least the bottom edge 17 is shaped to form a drip edge 20 along the bottom of the outside face 13 to inhibit migration of water across the bottom edge 17 to the inside face of the fascia board 12.

In the embodiment of FIG. 1, the fascia board 12 is extruded from a plastic composite material which may comprise, for example, polypropylene with fillers that may include wood fiber, sawdust, rice hulls, or any of a number of fillers known to those of skill in the art. Alternatively, the fascia board may be formed from extruded PVC plastic that preferably is blown to provide a lighter weight yet strong structure. Other materials such as other plastics, aluminum or galvanized steel, or even traditional wood may be used to fabricate the fascia boards. In one embodiment, the fascia vent is fabricated from a fire retardant material, preferably a material that meets "class A" fire rating standards. Traditional thermoplastic and composite materials may be rendered fire retardant by including certain additives such as, for example, magnesium trioxide, antimony, alpha-alkyl-D-glucoside, Silica gel combined with potassium carbonate, and other additives generally known to thermoplastic fabricators. The fascia vent also may be fabricated by methods other than extrusion such as, for instance, injection molding, thermoforming, or any other appropriate manufacturing technique. However, an extruded material such as extruded polypropylene with fillers is preferred because it is strong, durable, resistant to deterioration, and permits extrusion of the fascia boards in significantly longer lengths, which reduces installation time and the number of end joints that result when the fascia vent is installed.

The fascia board 12 is formed with an array of slots 21 that are spaced apart along the inside face 14 of the fascia board. Each of the slots 21 extends transversely from the bottom edge 17 of the fascia board a predetermined distance to upper ends 23. In the embodiment illustrated in FIG. 1, the slots extend approximately half the width of the fascia board, although longer or shorter slots are possible. The depth of each slot 21 is less than the thickness of the fascia board, the slots extending inwardly in the illustrated embodiment to the inside surface of the outer face 13. In the embodiment of FIG. 1, the slots 21 cut through the support ribs 18 to form air passages that communicate between and among the plurality of slots 21. Of course, in an embodiment in which the fascia board is solid, such as in a fascia board made of blown PVC or other plastic, or wood, air passages between adjacent slots are not formed when the slots are made. Thus, air passages communicating between and among the slots are not a requirement. The slots 21 may be formed by any appropriate process such as, for example, by being machined with a router or other cutting tool, by being cut out, or by being molded directly into the fascia board as it is extruded or otherwise formed.

Figure 2:
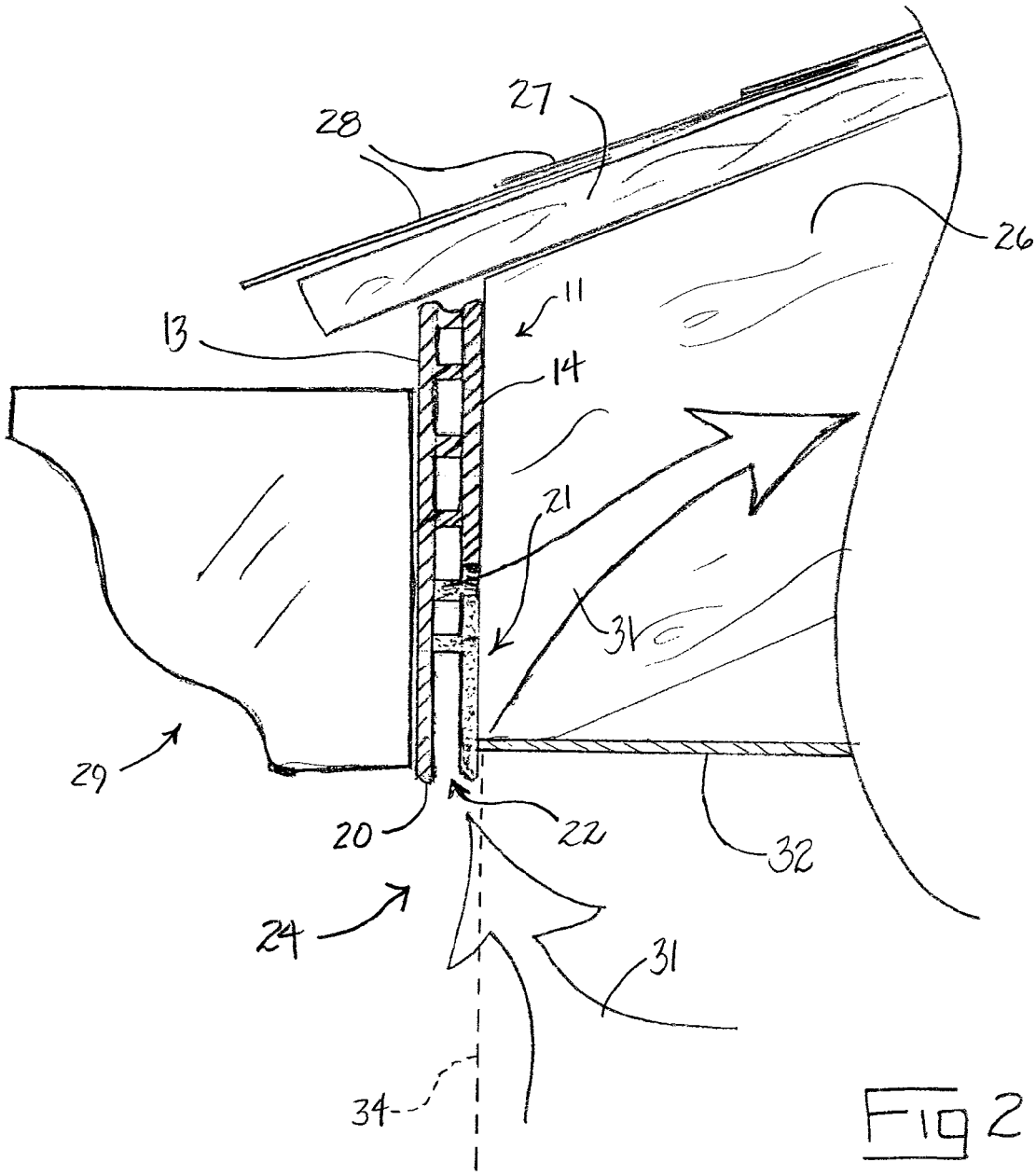
FIG. 2 is a cross sectional view showing the fascia vent of FIG. 1 installed and operational on a dwelling with a traditional soffit and overhang.

FIG. 2 shows the fascia vent 11 of FIG. 1 installed on a dwelling and is a cross section taken through one of the slots 21. More specifically, an eve 24 is formed from the projecting ends of roof rafters 26, roof decking 27 and shingles 28 secured atop the roof rafters, and a soffit board 32 enclosing the bottom of the resulting rafter bay. The fascia vent 11 is secured to the ends of roof rafters 26 with appropriate fasteners such as nails, screws, adhesives, hangers, or any other appropriate fasteners (not shown). The outside face 13 of the fascia vent is exposed and presents the appearance of a traditional fascia board secured to the dwelling. In this regard, the outside face 13 in composite or plastic embodiments of the fascia vent may be formed with impressions of wood grain to simulate more closely the appearance of a traditional wooden fascia board. Rain gutters 29 may be secured along the outside face 13 of the fascia vent 11 using fastening devices such as gutter spikes and brackets. The design of the preferred embodiment of the fascia vent with its extruded composite construction and internal support ribs provides rigidity and strength to allow for the penetration and support of gutter fasteners and rain gutters suspended thereon.

The slots 21 on the inside of the fascia board 12 are open to and communicate with ambience on their lower ends and extend upwardly above the soffit board 32 so that upper end portions of the slots are exposed to and communicate with the interior of the otherwise enclosed soffit bay. It will thus be seen that the slots together form a vent extending along the entire length of the fascia through which outside air is free to flow, as indicated by arrows 31, through the bottoms of the slots, into the soffit bay, and thus into the attic of the dwelling. In this way, the attic can be replenished with cool fresh outside air as hot attic air is expelled through ridge vents or other outlet vents higher on the roof.

While the fascia vent is illustrated in FIG. 2 installed along the overhang of a gable roof, it will be understood that it is equally useful for providing attic ventilation for dwellings having roofs without a traditional soffit or overhang. In such installations, the ends of the roof rafters are substantially flush with the outside wall of the dwelling, which is illustrated by phantom line 34 in FIG. 2, and the fascia vent is installed against the outside wall. The function of the fascia vent is substantially the same as described above, except that air flows directly into the attic space rather than first into an overhanging soffit bay.

Figure 3:
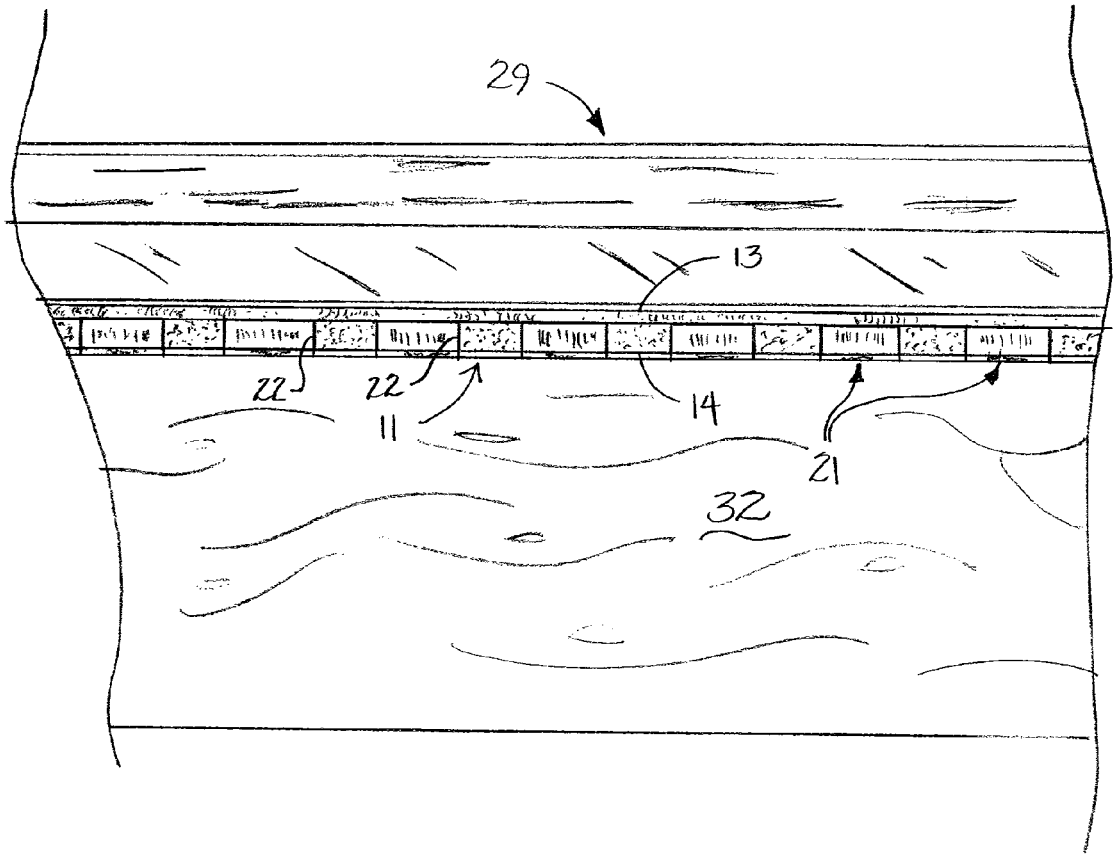
FIG. 3 is a view of the underside of the soffit and overhang of FIG. 2 illustrating how the slots in the fascia board form vents for inlet air to enter the attic space of the dwelling.

FIG. 3 is a view from the bottom of the soffit overhang of FIG. 1 and illustrates better the open lower ends 22 of the ventilating slots 21. It can be seen here that the ventilation slots are subtle and aesthetically pleasing and, in fact, are virtually undetectable when viewing a dwelling from a distance. This is an improvement over traditional soffit vents, which can be highly visible along the underside of the soffit and are considered by some to be unsightly. While not illustrated in the figures, the slots preferably are filled or covered with a material designed to prevent insects and moisture from migrating into the attic through the slots. For example, the lower ends 22 of the slots may be covered with an overlapping screen material or a vented strip with openings sized to allow ventilation while preventing insect migration. Alternatively, the slots may be filled with an open weave mesh material such as that used in the fabrication of Cobra® brand rolled ridge vent available from GAF Materials Corporation and described in U.S. Pat. No. 5,167,579. Such material permits air flow while inhibiting migration of insects and moisture through the vent slots.

The size and spacing of the vent slots 21 are predetermined to present a total net free ventilating area (NFA) at the soffit areas of a dwelling that compliments that of typical ridge or roof vent products. In this regard, a slot configuration that presents a total NFA of between 6 to 18 square inches for each foot of roof is preferred. In one particular example, a fascia vent according to the invention is provided with six vent slots per linear foot of fascia board. The width of each vent slot is 1 inch, the length of each slot to the semicircular top portion is 2 inches, the radius of the semicircle at the top of each slot is 0.5 inch, and the depth of each slot is 0.5 inch. With this configuration, the final installed NFA presented toward the attic space is about 11.3 square inches per linear foot of fascia vent where a 0.5 inch thick attic board is used for the soffit and about 9.9 square inches per linear foot of fascia vent where a 0.75 inch thick attic board is used. When the fascia on both sides of a roof are considered, these numbers are doubled to about 22.6 and 19.8 square inches for each foot of roof. Also for this example, the NFA per linear foot of fascia vent of the air inlet to the vent (i.e. the exposed bottom ends of the slots) is about 6.1 square inches per foot for a single fascia board and thus about 12.2 total square inches for each foot of roof. It thus will be seen that, for this example, the effective NFA for each foot of roof is about 12.2 square inches, which is within the preferred range and compliments well the NFA of typical ridge and roof vent products.

The invention has been described herein in the context of preferred embodiments and methodologies considered by the inventors to represent the best mode of carrying out the invention. It will be understood, however, that various modifications to the illustrated embodiments, both subtle and gross, may be made by skilled artisans without departing from the spirit and scope of the invention. For instance, while preferred materials for the fabrication of the fascia vent have been presented, any material or fabrication process suitable for making the fascia vent is intended to be included herein. Further, the particular configurations or shapes of the slots, their sizes, and their lateral extent all may be modified to meet a particular commercial application or need. The slots need not extend completely through the inside face of the fascia board along their entire lengths, but may, for instance, be enclosed at their bottoms and open within the soffit bay area of a roof. The scope of the present invention is not limited by these and other details but rather is defined and circumscribed only by the language of the following claims.

What is claimed is:

1. A fascia vent for installation underneath a roof overhang, the fascia vent comprising:

an elongated fascia board having an outside face, an inside face spaced from the outside face, a top edge, and a bottom edge, the fascia board being sized for installation along a lower edge of a roof and having at least one open space between the inside face and the outside face;

a plurality of spaced apart slots formed into and along the inside face of the fascia board and extending partially into the at least one open space between the inside and outside faces of the fascia board, each slot including a lower end that interrupts a bottom edge of the inside face to open the slot to ambience, and each slot extending upward along the inside face from the lower end to an upper end spaced from the top edge of the fascia board and located above a soffit board installed beneath the roof overhang;

wherein each slot defines a vent path extending into and along a portion of the inside face of the fascia board from the bottom edge of the inside face to above the soffit board and opening into an interior of a soffit bay of the roof, and the slots further being sized and shaped to present a net free ventilating area pre-selected to compliment a net free ventilating area of an attic exhaust vent to be used together with said fascia vent.

2. A fascia vent as claimed in claim 1, and wherein the slots extend substantially transversely relative to the elongated fascia board.

3. A fascia vent as claimed in claim 1 and wherein the fascia board is formed of an extruded material that includes a plastic.

4. A fascia vent as claimed in claim 3 and wherein the extruded material is a blown plastic.

5. A fascia vent as claimed in claim 3 and wherein the extruded material is a composite of plastic and a filler.

6. A fascia vent as claimed in claim 5 and wherein the filler is wood fiber.

7. A fascia vent as claimed in claim 1 and further comprising a plurality of support ribs extending longitudinally between and connecting the inside and outside faces of the fascia board to form the at least one open space, the support ribs being spaced apart to define the at least one open space as longitudinal channels extending through the fascia board, and with each of the plurality of slots intersecting at least a lowermost support rib to extend the vent path into the longitudinal channels between the inside and outside faces of the fascia board.

8. A fascia vent as claimed in claim 7 and wherein the longitudinal channels establish air flow paths communicating between the spaced apart slots.

9. A fascia vent as claimed in claim 1 and wherein a bottom edge of the outside face is shaped to define a drip edge.

10. A fascia vent as claimed in claim 1 and wherein the elongated fascia board is formed of a material that is fire retardant.

11. A fascia vent as claimed in claim 10 and wherein the material from which the fascia board is formed comprises a thermoplastic material with fire retardant additives.

12. A fascia vent as claimed in claim 11 and wherein the thermoplastic material is a composite of plastic and a filler.

13. A roof structure on a dwelling comprising:

rafters having ends;

a roof deck supported atop the rafters overlying an attic space;

a fascia vent secured to the ends of the rafters and extending along an edge of the roof structure;

said fascia vent comprising an elongated fascia board having an upper edge adjacent the roof deck, a bottom edge, an exposed outer surface and an inner surface facing in an opposite direction from said outside surface, the inner surface having a plurality of slots formed therein, each slot having a lower end that interrupts a bottom edge of the inside face to open the slot to ambience, and each slot extending upward along the inside face from the lower end to an upper end spaced a predetermined distance above the bottom edge of the fascia board and exposed to and communicating with the attic space, each of the slots having a depth less than a thickness of the fascia board and extending inwardly partially into a space between the inside and outside faces;

wherein the slots are sized and shaped to present a net free ventilating area between about 6 square inches per lineal foot of the fascia vent to about 18 square inches per lineal foot of the fascia vent.

14. A roof structure as claimed in claim 13 and wherein the ends of the rafters are substantially aligned with an outside wall of the dwelling.

15. A roof structure as claimed in claim 13 and wherein the ends of the rafters extend beyond an outside wall of the dwelling to form an overhang.

16. A roof structure as claimed in claim 15 and further comprising a soffit board covering a bottom of the overhang, the exposed lower ends of the slots being arrayed along an outside edge of the soffit board.

17. A roof structure as claimed in claim 13 and wherein the fascia vent is formed of a material that includes plastic.

18. A roof structure as claimed in claim 17 and wherein the plastic includes polypropylene.

19. A roof structure as claimed in claim 17 and wherein the plastic includes polyvinylchloride.

20. A roof structure as claimed in claim 17 and wherein the material further includes a filler.

21. A roof structure as claimed in claim 20 and wherein the filler is wood fiber.

22. A roof structure as claimed in claim 17 and wherein the fascia vent is extruded from the material that includes plastic.

23. A method of providing ventilation into an attic space beneath a roof structure that includes a fascia board, the method comprising the steps of:

(a) forming a plurality of spaced slots into and along an inside face of the fascia board, each slot extending partially into a space between the inside face and an outside face to a depth less than a thickness of the fascia board, with a lower end of each slot interrupting a bottom edge of the inside face to open the slot to and communicating with ambience, and each slot extending upward along the inside face from the lower end to an upper end that is open to and communicating with the attic space, wherein each slot extends upwardly from the bottom edge of the inside face a predetermined distance of approximately one half a width of the fascia board to its upper end, and (b) venting air from within the attic to cause fresh replacement air to be drawn through the lower ends of the slots upwardly along the slots to the upper ends thereof and from the upper ends of each of the slots into the attic space.

24. The method of claim 23 and wherein step (a) comprises sizing the plurality of slots to present a predetermined net free ventilating area.

25. The method of claim 24 and wherein the net free ventilating area is between about 6 square inches per lineal foot of the fascia board and about 18 square inches per lineal foot of the fascia board.

* * * * *